United States Patent [19]

Forgo

[11] 4,210,448

[45] Jul. 1, 1980

[54] PROCESS FOR ELECTROPHOTOGRAPHIC IMAGE FORMATION AND TRANSFER

[75] Inventor: Gabor Forgo, Zurich, Switzerland

[73] Assignee: Elfotec A.G., Zumikon, Switzerland

[21] Appl. No.: 733,494

[22] Filed: Oct. 18, 1976

[30] Foreign Application Priority Data

Oct. 21, 1975 [DE] Fed. Rep. of Germany ..... 2547118

[51] Int. Cl.[2] ..... G03G 13/16; G03G 9/14

[52] U.S. Cl. ..... 430/126; 96/15 D; 252/62.1 P; 252/62.51; 430/122; 430/276; 430/10; 430/937

[58] Field of Search ..... 96/15 D, 1.4; 252/62.1 P, 62.51, 62.55

[56] References Cited

U.S. PATENT DOCUMENTS

| | | | |
|---|---|---|---|
| 2,846,333 | 8/1958 | Wilson | 96/15 D X |
| 2,911,330 | 11/1959 | Clark | 96/1 R |
| 3,146,100 | 8/1964 | Kaufman | 96/15 D |
| 3,592,675 | 7/1971 | Cheng | 118/637 |
| 3,639,245 | 2/1972 | Nelson | 252/62.1 P |
| 3,645,770 | 2/1972 | Flint | 96/15 D X |
| 3,791,843 | 2/1974 | Kohlmannsperger | 346/1 |
| 3,938,993 | 2/1976 | Royka et al. | 96/1.4 |

*Primary Examiner*—Roland E. Martin, Jr.
*Attorney, Agent, or Firm*—Arnstein, Gluck, Weitzenfeld & Minow

[57] ABSTRACT

Sharp, high-resolution copies of electrostatc images developed with a one-component magnetic toner can be obtained by corona transfer to a copy sheet if toner resistivity is at least $10^{13}$ ohm-cms. Such resistivity is attainable by incorporating carbon within the toner particles in an amount preferably about 1 to 1.3 per cent by weight, the surface of the toner particles either not having any carbon thereon or it being present in amounts of at most 0.7 per cent by weight.

10 Claims, 2 Drawing Figures

PROCESS FOR ELECTROPHOTOGRAPHIC IMAGE FORMATION AND TRANSFER

BACKGROUND OF THE INVENTION

1. Field of the Invention

This invention relates to a process for electrophotographic image formation in which a magnetic brush from a magnetic one-component toner is used to develop a latent image.

2. Description of Prior Art

Commonly used one-component magnetic toners are of relatively low resistance. They have, for example, a resistivity in the range of approximately $10^2$ to $10^6$ ohm-cms. This low resistance is a consequence of the accretion of conductive carbon components at the surface of the toner particles, thereby facilitating charging of the toner induced by the charge image on the photoconductor (in contrast to triboelectric charging of a two-component toner).

If the developed charge image on the photoconductor itself is used as the copy in the direct process, the noted low resistance of the toner usually has no effect on the achievable image quality. If an indirect, so-called transfer process is used, however, to transfer the developed charge image onto another image carrier, then this low resistance is troublesome because it causes both lower acutance and lower image resolution.

To understood this effect, what happens in the transfer process shall be explained briefly. After a charge image on the photoconductor is developed by means of a relatively low-resistance one-component toner, the latter is situated on the photoconductor with a positive induced charge, for example. By applying a negative potential to a transfer roller, say, the one-component toner is conveyed onto a receiving sheet which lies between the toner image and the roller and is destined to record the image, e.g., a sheet of paper.

Since the paper sheet is not highly insulating and the one-component toner is of relatively low resistance, the latter, to the extent that it is situated on the paper's surface, can have its charge reversed, i.e., this one-component toner on the paper sheet now receives a negative charge and therefore begins to migrate in the opposite direction, i.e., back to the photoconductor. This process is repeated in time as long as the relevant toner particles are situated spatially in the region of influence of the transfer field. It should be noted that the described charge-reversal process occurs more quickly the lower the resistance of the one-component toner.

Since the back-and-forth migration of toner does not occur in a straight line even in a stationary system of electrodes, the duration of action, broad field zone and low-resistance one-component toner commonly used in practice result in an untolerable blurring and unacceptable loss of resolution in the transferred image.

By using a transfer roller subjected to a voltage and pressed against the back of the receiving sheet, it is possible, because of the contact pressure, to realize a shortest possible transfer distance and a temporally and spatially limited transfer field acting on a particular toner particle in the region of the transfer-roller's directrix most closely adjacent to the photoconductor. The previously mentioned impairment of image quality can be reduced somewhat by these measures, but the roller transfer process is affected by additional disadvantages.

Thus, the transfer field should be switched on just after the receiving sheet enters the transfer area and switched off just before the sheet exits from that area so as to be able to use the entire format area and avoid the danger of voltage puncture or sparkover onto the photoconductor. The photoconductor would be damaged by such a puncture or sparkover. Furthermore, the transfer roller itself can attract toner particles which subsequently smudge the back of the next copy. For that reason, it is necessary to provide a special cleaning device for the transfer roller. Moreover, due to the high contact pressure of the transfer roller required for obtaining usable image quality, the danger of mechanical damage to the photoconductor also cannot be excluded. Finally, there are considerable difficulties in changing the paper format for the receiving sheet. Because of the danger of voltage sparkover at the edge of the sheet, the transfer field would have to be laterally limitable if receiving sheets of smaller format were also to be usable, which would require quite a sizable engineering effort and cause considerable operating problems.

The noted difficulties with the roller transfer process thus represent considerable disadvantages.

SUMMARY OF THE INVENTION

The object of this invention is therefore to create a process for electrophotographic image production with a magnetic one-component toner that avoids the previously described disadvantages and, in particular, permits application of the technically simpler corona transfer process and assures a high acutance of the produced image and a high image-resolution.

More specifically, this invention relates to a process for electrophotographic image production by the corona transfer process, characterized by the fact that a magnetic one-component toner having a resistivity of at least $10^{13}$ ohm-cms is used for the image production.

Further characteristic features and process steps of the invention are given in the claims.

BRIEF DESCRIPTION OF THE DRAWING

The invention is described in the following with reference to the accompanying drawing in which.

DESCRIPTION OF THE PREFERRED EMBODIMENTS

The invention is described in more detail in the following.

With the aim of achieving a copy quality exhibiting acutance and high image-resolution and avoiding the problems of the roller transfer process, a corona transfer process is used in which back-and-forth migration of toner particles is effectively prevented by utilizing a one-component magnetic toner having extremely high resistance. The resistivity of the toner is at least $10^{13}$ ohm-cms and is achieved by maintaining a carbon content of at most 0.7 percent by weight on the surface of the toner particles. In the interior of the toner particle, a carbon content of 1 to 1.3 percent by weight is already sufficient.

The above-mentioned low percentage of carbon at the surface is not used to produce a certain conductivity, but rather to improve the flow properties of the toner, the carbon at the surface thus serving as a lubricant. It was discovered that the lubricating effect and the improvement of the flow properties can also be achieved without carbon, e.g., by admixture of other flow agents such as $SiO_2$ or by smoothing the particle surface, e.g., by applying frictional heat or radiation heat to the particles.

It is thus established that this process is realized with a new type of one-component toner. It is also possible to use a one-component toner having an elevated content of carbon, e.g. 5%, if care is taken that the carbon not be located at the surface of the toner particles. Such one-component toners with higher content of carbon in the interior can be fabricated by spray drying or by grinding the dried toner-melt and, because of their high resistivity, yield an excellent image quality, acutance and image resolution in the corona transfer process.

In this manner, the advantages of the corona transfer process, with its simple engineering design, and the well-known advantages of the magnetic one-component toner can be combined without having to put up with the disadvantages described previously.

Figure 1:
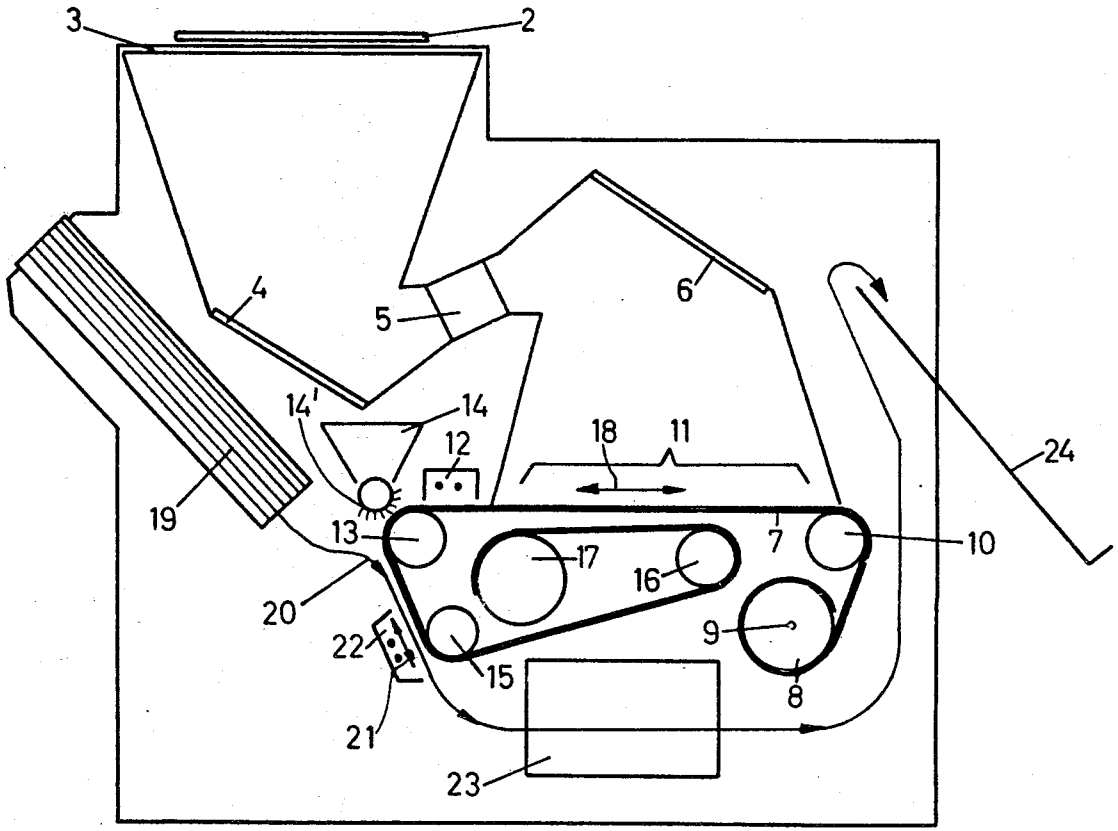
FIGS. 1 and 2 show examples of devices for carrying out the process according to the invention. In these figures, corresponding parts of the devices are provided with the same reference numerals.

In FIG. 1, the reference 1 denotes the image-producing apparatus as a whole. An original 2 to be copied is placed with its image side facing downwards on a glass plate 3. During the image-producing process, lamps (not shown in FIG. 1) periodically illuminate the image side of the original 2. Light reflected from the original 2 is projected by a first mirror 4 through an optical system 5 and by a second mirror 6 onto a sheet-form intermediate image carrier 7 provided with the photoconductor. In this first embodiment, the intermediate image carrier 7 consists of a flexible sheet of insulating material, for example "Mylar", with a thin metal coating and, over that metal coating, a photoconductor, for example ZnO, and binder.

One end of the intermediate image carrier 7 is wound onto a first roll 8. The first roll 8 is mounted for rotation about its axis 9 and is connected to a drive mechanism (not shown in FIG. 1). From the first roll 8, the intermediate image carrier 7 travels around a first guide roller 10 into an exposure zone 11. Inside the exposure zone 11, the image side of the original 2 is reproduced on that part of the intermediate image carrier 7 situated in the exposure zone or on its photoconductor by the optical means 4, 5 and 6 referred to above. Adjacent the exposure zone 1, there is a charging unit 12, for example a high-voltage corona, past which the intermediate image carrier 7 travels. The intermediate image carrier 7 then travels around a second guide roller 13. A magnetic brush 14 is arranged adjacent the guide roller 13. From the second guide roller 13, the intermediate image carrier 7 travels around a third guide roller 15 and then around a fourth guide roller 16 and finally onto a second roll 17.

The first roll 8 and the second roll 17 are coupled by a drive mechanism (not shown in FIG. 1) which enables the intermediate image carrier to travel either towards the first roll 8 or towards the second roll 17. In this way, it is possible to move the intermediate image carrier 7 in the two directions indicated by the double arrow 18 in the exposure zone 11.

The apparatus 1 further comprises a paper magazine 19 from which individual sheets can be taken, being guided over guide means (not shown in FIG. 1) along the path 20 to the intermediate image carrier 7. The paper enters a transfer zone 21 sheet by sheet. The transfer zone 21 is situated in the vicinity of the guide roller 15 and a transfer corona 22 arranged there for the transfer process.

After leaving the transfer zone 21, the intermediate image carrier 7 travels around the guide roller 15 to the guide roller 16, whilst the sheet of paper introduced into the transfer zone 21 is guided by further guide means (not shown in FIG. 1) first into a fixing zone 23 and then by further guide means (again not shown in FIG. 1) into an output zone 24. Now that the structure of the apparatus 1 has been established, the individual stages of an image-producing cycle will be described:

1. By switching on the drive means for the first roll 8 and second roll 17, the intermediate image carrier 7 is wound onto the first roll 8 and offwound from the second roll 17, so that it moves from left to right in the horizontal section of its travel in the vicinity of the exposure zone 11.

2. Before entering the exposure zone 11, the intermediate image carrier 7 is uniformly electrostatically charged by temporarily switching on the charging unit 12.

3. After it has entered the exposure zone 11, the intermediate image carrier 7 is briefly stopped and exposed according to the image side of the original 2 by switching on the lamps provided for the original 2. In this way, a latent electrostatic charge image is formed in known manner.

4. The drive means for the first roll 8 and the second roll 17 are then reversed, or kept in operation, in such a way that the intermediate image carrier 7 is now offwound from the first roll 8 and wound onto the second roll 17. Accordingly, the intermediate image carrier 7 moves from right to left in the horizontal section of its travel. The charging unit 12 is switched off.

5. As the intermediate image carrier 7 travels past the magnetic brush 14, the latent electrostatic charge image formed on it after exposure in the exposure zone 11 is developed to form a toner image by the deposition of toner onto the intermediate image carrier 7. According to the invention, a magnetic one-component toner, for example of the type described in U.S. Pat. No. 3,639,245, is provided for forming the brush coating 14' of the magnetic brush 14.

6. The intermediate image carrier with its toner image then passes through the transfer zone 21, in which the toner image is transferred to a sheet of paper taken from the paper magazine 19 and simultaneously introduced into the transfer zone 21 after the transfer corona 22 has been temporarily switched on.

7. After passing through the transfer zone, the sheet of paper now provided with the toner image passes through the fixing zone 23. Fixing may be obtained, for example, by infrared irradiation.

8. After the toner image has been fixed in the fixing zone 23, the now completed copy of the original 2 enters the output zone 24.

9. Before another image-producing cycle can be commenced, and at the very least when a new original 2 is to be copied, the intermediate image carrier 7 has to be cleaned. The residues of toner still adhering to it have to be removed. According to the invention, the intermediate image carrier 7 is cleaned by being returned from the second roller 17 to the first roller 8 by reversing the drive mechanism for the rollers 8 and 17 either immediately after the transfer process, but at the latest at the beginning of a new image cycle. During its return to the first roller 8, the intermediate image carrier 7 strips the coating 14' of the magnetic brush 14. By virtue of the fact that the one-component toner particles provided in accordance with the invention themselves contain magnetizable or magnetic material, the toner residues are magnetically attracted by the magnetic system present in the magnetic brush 14, in other words they are removed from the intermediate image carrier 7. It should be noted that this cleaning process does not involve the application of a d.c. voltage of certain polarity between the intermediate image carrier and the magnetic brush. It should also be noted that, by returning the toner residues, any reduction in the thickness of the brush coating 14' is counteracted insofar as the toner residues are introduced back into the coating. It should also be noted that there is no change in the developer because it consists of only one component, namely the magnetic or magnetizable toner particles. Accordingly, in contrast to magnetic brushes with magnetic particles and toner particles chargeable by frictional electricity which are introduced into the brush, the properties of the developer remain constant in accordance with the present invention. There is no reduction in the toner content.

According to the invention, the coating 14' of the magnetic brush 14 consists of toner particles which comprise, for example, a core of magnetizable or magnetic material covered by a layer of only limited conductivity. It should be noted that the toner itself has hardly any electrical charge, but can be magnetically attracted and, accordingly, may be used for forming the brush-like coating 14' of the magnetic brush 14. However, the toner particles can be attracted onto the intermediate image carrier 7 by an electrical field of the kind which emanates from the latent charge image on the intermediate image carrier 7, and may also be subsequently attracted again from the charge image carrier onto the opposite sheet of paper during the transfer process. It should be noted that, contrary to standard procedure, the magnetic brush 14 does not have to be applied to a voltage of predetermined polarity either for developing the latent charge image or for cleaning the intermediate image carrier, instead the electrical field emanating from the latent charge image is in itself entirely adequate for attracting the toner particles for developing the latent charge image.

The brush-like coating 14' of the magnetic brush 14 consisting of a magnetic one-component toner not only affords the practical advantage of simplifying the apparatus by eliminating the need for a special voltage source with an associated reversing switch, it also affords the further advantage of obviating the difficult problem of toner regeneration referred to earlier on. It is entirely sufficient to keep the level of the brush-like coating 14' constant, for example, by means of a stripper. There are no longer any problems in regard to the composition of the toner.

Figure 2:
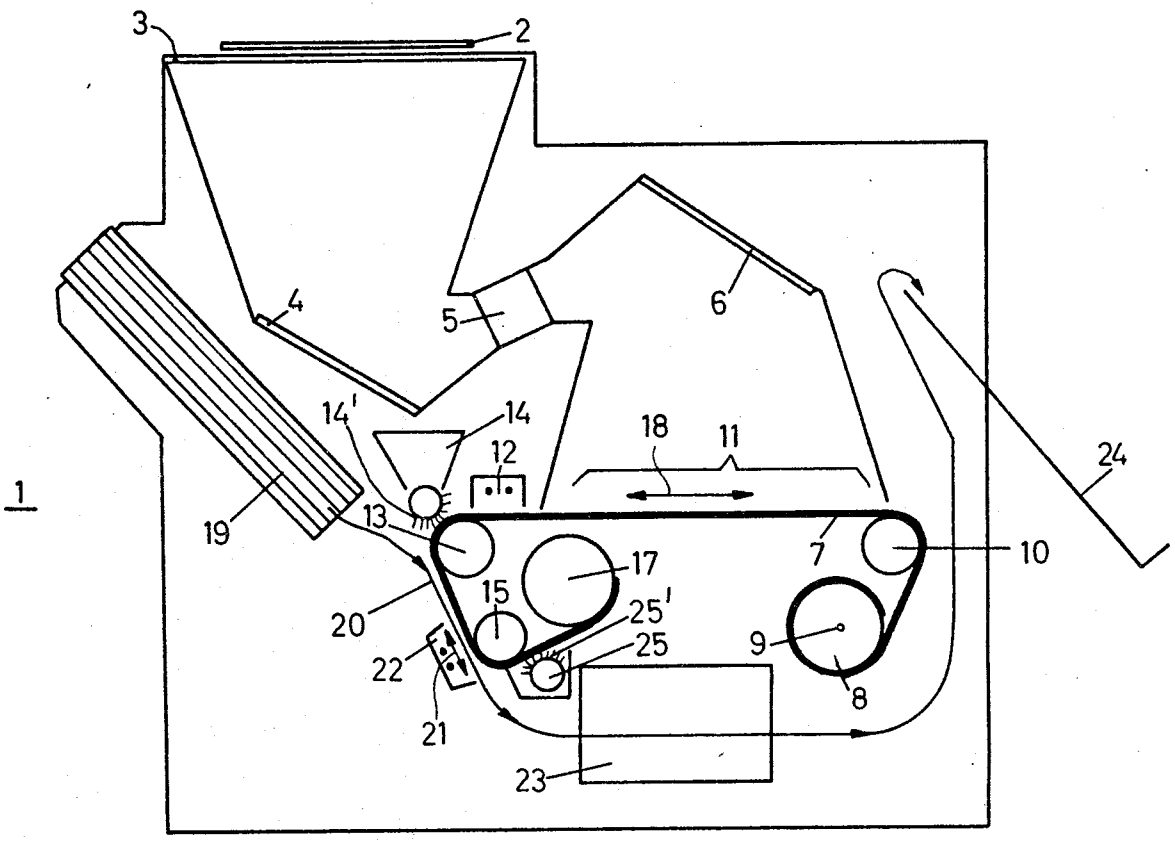

FIG. 2 diagrammatically illustrates a second exemplary embodiment. The structure of the apparatus is largely the same as in FIG. 1. However, one difference is that the magnetic brush 14 is provided for development whilst another identical magnetic brush 25 is provided for cleaning the intermediate image carrier 7. The magnetic brush 25 provided for cleaning is preferably arranged in the vicinity of the guide roller 15. In the embodiment described with reference to FIG. 1, the intermediate image carrier is only cleaned during its return, i.e., as it passes the magnetic brush 14. Accordingly, it would be inappropriate, in the embodiment illustrated in FIG. 1, to wind the intermediate image carrier 7 after it has left the roll 15 directly onto the roll 17, because in that event the toner residues adhering to it would soil its lower surface after winding onto the roll 17. For this reason, the further guide roller 16 is provided in the embodiment shown in FIG. 1, so that the intermediate image carrier 7 travels an adequate distance before being wound onto the roll 17, so that soiled parts do not enter the roll 17. In the second embodiment shown in FIG. 1, however, the intermediate image carrier 7 is cleaned immediately after the guide roller 15, so that it is possible to wind it onto the second roll 17 immediately afterwards. This considerably simplifies the apparatus. A compact coating 25' is formed on the magnetic brush 25 over numerous cleaning cycles. When this coating has reached an adequate density, it is possible, for example, to remove the entire magnetic brush 25 from the apparatus and to use it, for example, as a replacement for the magnetic brush 14.

In addition to using a sheet-form charge image carrier 7, it is of course also possible to use a drum-like charge image carrier 7, in which case the individual components of the apparatus, namely the exposure stage, the charging stage 12, the magnetic brush 14, the transfer corona 12 and the second magnetic brush 25, if any, are arranged radially around the drum-like intermediate image carrier 7.

What is claimed is:

1. Process for electrophotographic image production by the toner transfer process by use of a corona, comprising applying in the absence of applied potential field a magnetic one-component toner having a resistivity of at least $10^{13}$ ohm-cms and comprising particles which have a core of magnetizable or magnetic material and a carbon content of the surface of the toner particles of at most 0.7 percent by weight which has not been charged by applied potential field or by frictional electricity for production of the image, and transferring the produced toner image to a surface by applying a corona thereto.

2. Process according to claim 1, wherein the surface of the toner particles contains no carbon.

3. Process according to claim 1, wherein the surface of the toner particles contains a flow agent.

4. Process according to claim 3, wherein $SiO_2$ is provided as flow agent.

5. Process according to claim 1, wherein the surface of the toner particles is smoothed.

6. Process according to claim 1, wherein the toner is fabricated by spray drying.

7. Process according to claim 1, wherein the toner is fabricated by grinding the dried toner melt.

8. Process for electrophotographic production of images, in which a magnetic brush formed from a one-component toner is used for developing a latent image, transfer of said toner from the brush to an intermediate image carrier occurring solely through the electric field of the latent image, according to claim 1, wherein the toner image is transferred to the final sheet by means of corona transfer, the one-component toner comprises particles which have a core of magnetizable or magnetic material coated with a layer having a low conductivity, and cleaning of the intermediate image carrier after a transfer operation by use of a magnetic brush made of the same magnetic one-component toner and the crossover of the toner from the intermediate image carrier to the brush being effected solely through the magnetic system of the brush.

9. Process according to claim 8 wherein the same magnetic brush is utilized both for the transfer of toner from the brush to the intermediate image carrier during development and also for the transfer of toner from the intermediate image carrier to the brush during the cleaning of the intermediate image carrier.

10. Process according to claim 8, wherein two separate magnetic brushes are utilized, and from time to time the brush used for development is replaced by the brush used for cleaning.

* * * * *

UNITED STATES PATENT OFFICE
CERTIFICATE OF CORRECTION

PATENT NO. : 4,210,448
DATED : July 1, 1980
INVENTOR(S) : GABOR FORGO

It is certified that error appears in the above-identified patent and that said Letters Patent are hereby corrected as shown below:

Column 3, line 45, the numeral "1" should read --11--.

Column 6, line 3,"FIG. 1" should read --FIG. 2--.

Signed and Sealed this

*Twenty-third* Day of *September 1980*

[SEAL]

*Attest:*

SIDNEY A. DIAMOND

*Attesting Officer*

*Commissioner of Patents and Trademarks*